US007011374B1

(12) United States Patent
Hsieh

(10) Patent No.: US 7,011,374 B1
(45) Date of Patent: Mar. 14, 2006

(54) SEAT DEVICE FOR A CHAIR

(75) Inventor: Duan-Cheng Hsieh, Taipei (TW)

(73) Assignee: Habitex Corporation, Taipei (TW)

( * ) Notice: Subject to any disclaimer, the term of this patent is extended or adjusted under 35 U.S.C. 154(b) by 0 days.

(21) Appl. No.: 10/958,310

(22) Filed: Oct. 5, 2004

(51) Int. Cl.
*A47C 7/14* (2006.01)

(52) U.S. Cl. ..... 297/452.56; 297/440.11; 297/452.13

(58) Field of Classification Search ..... 297/45, 297/452.56, 452.13, 440.11; 5/186.1
See application file for complete search history.

(56) References Cited

U.S. PATENT DOCUMENTS 1,450,951 A * 4/1923 Cruyt ..... 5/186.1
2,127,710 A * 8/1938 Baker ..... 5/186.1
5,747,140 A * 5/1998 Heerklotz ..... 297/452.56
6,152,534 A * 11/2000 Maeda et al. ..... 297/452.56
6,193,318 B1 * 2/2001 Becker et al. ..... 297/452.56

* cited by examiner

*Primary Examiner*—Peter M. Cuomo
*Assistant Examiner*—Stephen D'Adamo
(74) *Attorney, Agent, or Firm*—Abelman, Frayne & Schwab

(57) ABSTRACT

A seat device for a chair includes at least two outer sheet layers made of a stretchable elastic textile material, and an inner sheet layer of a textile material sandwiched by the outer sheet layers. The inner sheet layer has a second marginal part surrounding substantially an entire area thereof and secured to first marginal parts of the outer sheet layers. An attachment member is associated with the first and second marginal parts and is adapted to be mounted on the chair. The entire area of the inner sheet layer is larger than that of a respective outer sheet layer so that the inner sheet layer creases when the outer sheet layers lay flat. The inner and outer sheet layers form a concaved configuration when a pressure is exerted on the inner and outer sheet layers along a direction transverse to the same.

4 Claims, 7 Drawing Sheets

SEAT DEVICE FOR A CHAIR

BACKGROUND OF THE INVENTION

1. Field of the Invention

The invention relates to a seat device, more particularly to a seat device for a chair.

2. Description of the Related Art

Referring to FIGS. 1 and 2, a conventional seat cushion 11, 11' for a chair assembly 1, 1' is generally supported by a leg assembly 12, 12'. The seat cushion 11 shown in FIG. 1 is made by covering a cotton layer 111 with a synthetic leather 112, thereby providing comfort to a user. The seat cushion 11' shown in FIG. 2 is made by molding a fabric sheet into a bowl-shaped fabric cushion 113, which corresponds to the sitting posture of a user. The fabric cushion 113 is then mounted detachably on a main frame 13 of a modular chair assembly 1'.

Because the synthetic leather 112 and the cotton layer 111 are easily deformed due to different loads they bear, the conventional seat cushion 11 eventually becomes permanently deformed over time, and therefore becomes uncomfortable to use. As to the fabric cushion 113, since it is made of a non-stretchable fabric material, it cannot match the body shape of each user, and is thus uncomfortable to sit on. Furthermore, since the fabric cushion 113 is not ergonomically sound, the user may suffer body fatigue and pain during long use of the fabric cushion 113, and in the worst case, the pain may be severe and the spinal cord may even be injured.

SUMMARY OF THE INVENTION

Therefore, the object of the present invention is to provide a seat device for a chair that may lay flat in the absence of an external force.

Another object of the present invention is to provide a seat device for a chair that is comfortable to sit on.

According to this invention, a seat device for a chair comprises at least two outer sheet layers made of a stretchable elastic textile material, an inner sheet layer of a textile material sandwiched by the outer sheet layers, and an attachment member. Each of the outer sheet layers has a first marginal part surrounding substantially an entire area of a corresponding one of the outer sheet layers. The inner sheet layer has a second marginal part surrounding substantially an entire area of the inner sheet layer and secured to the first marginal parts. The attachment member is associated with the first and second marginal parts, and is adapted to be mounted on the chair. The entire area of the inner sheet layer is larger than the entire area of the outer sheet layers so that the inner sheet layer creases when the outer sheet layers lay flat. The inner and outer sheet layers form a concaved configuration when a pressure is exerted on the inner and outer sheet layers along a direction transverse to the inner and outer sheet layers.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
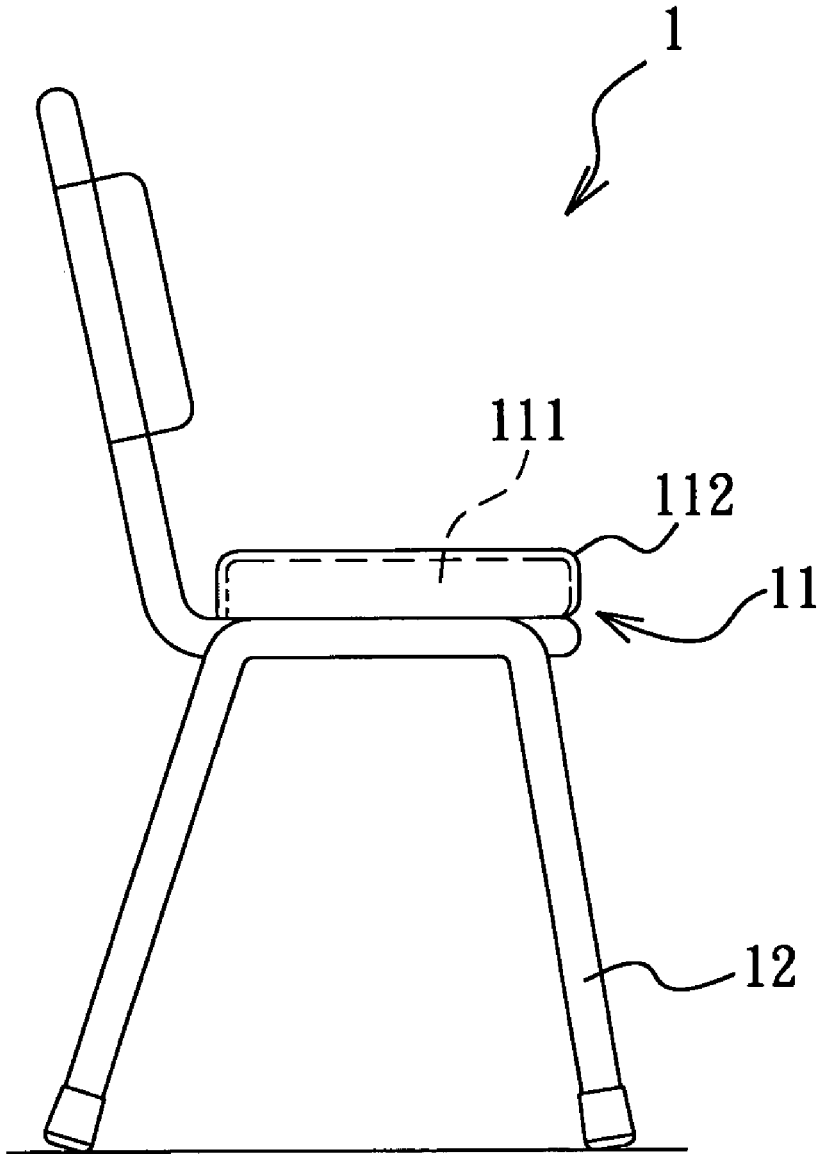
F I G. 1 PRIOR ART
FIG. 1 is a schematic side view of a chair incorporating a conventional seat cushion.
Figure 2:
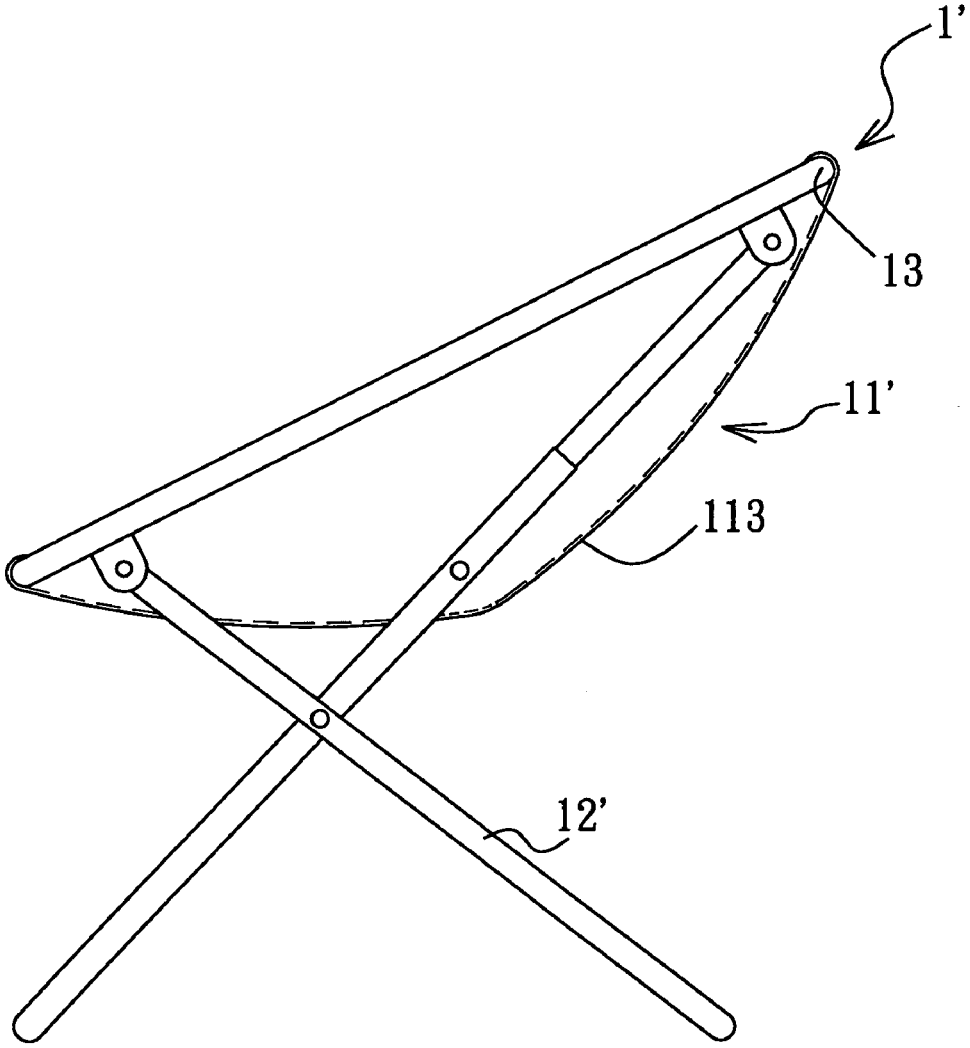
F I G. 2 PRIOR ART
FIG. 2 is a schematic side view of a chair incorporating another conventional seat cushion.
Figure 3:
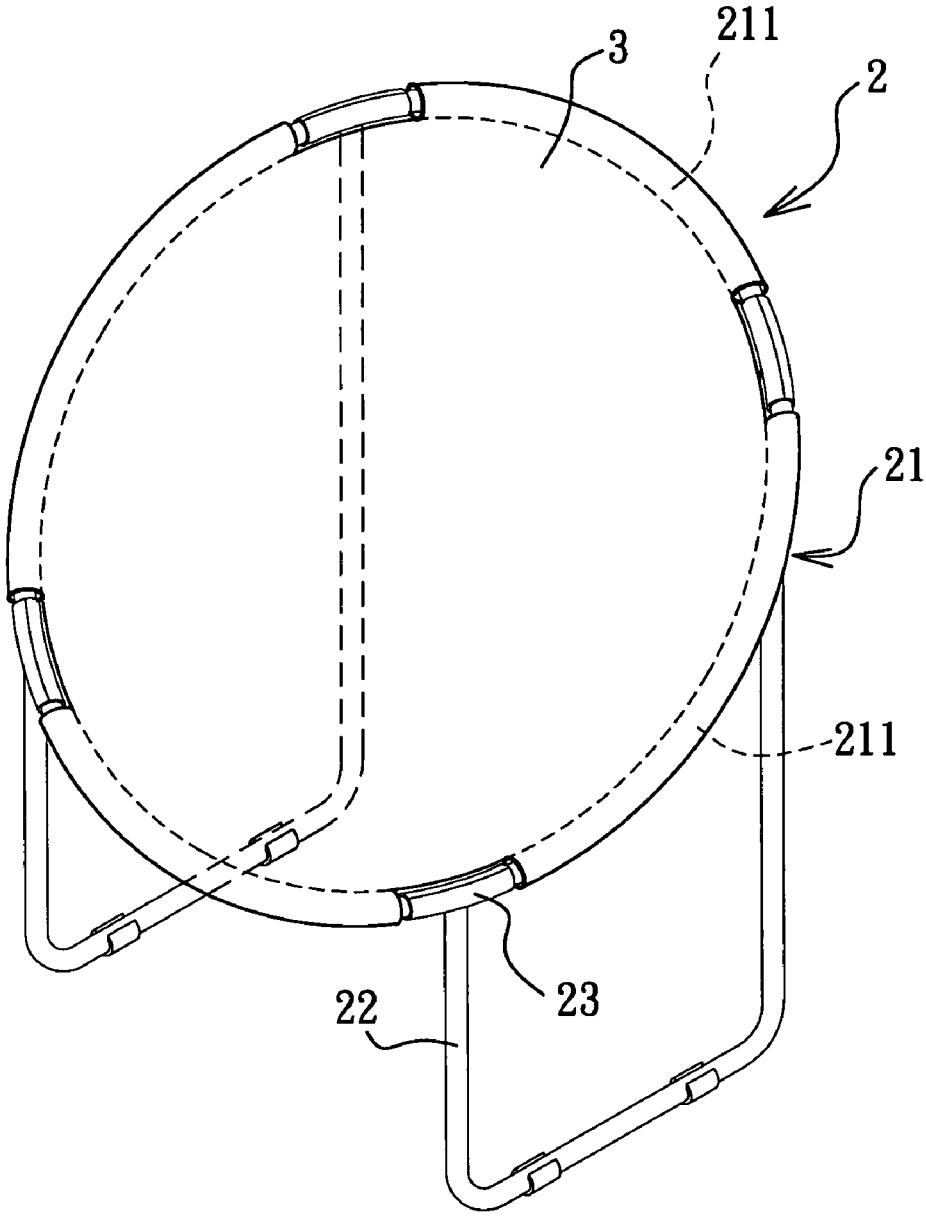
FIG. 3 is a perspective view of a modular chair assembly incorporating the preferred embodiment of a seat device of the present invention.
Figure 4:
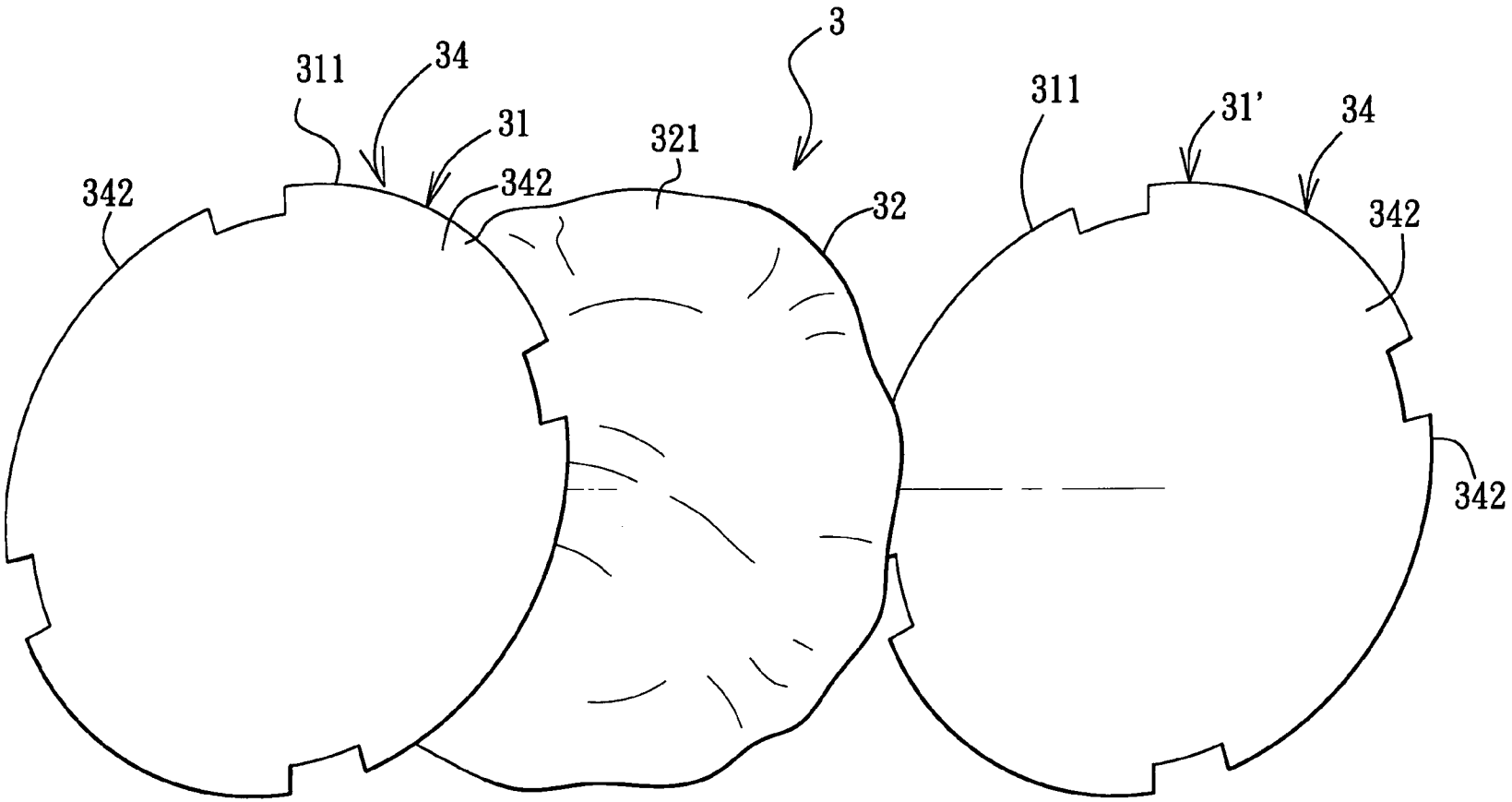
FIG. 4 is an exploded perspective view of the preferred embodiment.

Referring to FIGS. 3 and 4, the preferred embodiment of a seat device 3 according to the present invention is adapted to be mounted on a modular chair assembly 2. The seat device 3 may also be applied to an office chair, a dining chair, etc., and should not be limited to the disclosed embodiment.

The modular chair assembly 2 includes a ring-shaped main frame 21, which is made up of a plurality of detachable connecting rods 211, two substantially U-shaped legs 22 supporting the main frame 21 on a supporting surface, such as the ground, and a plurality of link units 23 interconnecting the main frame 21 and the legs 22.

The seat device 3 of the present invention is adapted to be mounted on the main frame 21 of the modular chair assembly 2, and includes two outer sheet layers 31, and an inner sheet layer 32 sandwiched by the outer sheet layers 31. In this embodiment, each of the outer sheet layers 31 is made of a stretchable elastic textile material. The stretchable elastic textile material includes elastomeric polyurethane fibers, and such a material is well known under the trademark "Spandex." However, the outer sheet layers 31 should not be limited to this embodiment, and may be any other suitable stretchable elastic textile material. Each outer sheet layer 31 has a first marginal part 311 surrounding substantially an entire area of a corresponding outer sheet layer 31.

The inner sheet layer 32 is made of a textile material, which is not elastic or which is comparatively less elastic than the outer sheet layers 31. The textile material, in this embodiment, includes polyethylene terephthalate fibers (Trade Mark "Tetoron," by Toray Industries Inc.). The inner sheet layer 32 has a second marginal part 321 surrounding substantially an entire area of the inner sheet layer 32. The second marginal part 321 is sewn to the first marginal parts 311. The entire area of the inner sheet layer 32 is larger than the entire area of a respective outer sheet layer 31 so that the inner sheet layer 32 creases when the outer sheet layers 31 lay flat. When a pressure is exerted on the inner and outer sheet layers 32, 31 along a direction transverse to the inner and outer sheet layers 32, 31, the inner and outer sheet layers 32, 31 form a concaved configuration. Preferably, the inner sheet layer 32 is substantially bowl-shaped.

The inner and outer sheet layers 32, 31 are provided with an attachment member 34, which is adapted to be mounted on the modular chair assembly 2. In this embodiment, the attachment member 34 is formed as a plurality of spaced-apart sleeve portions 342 at the first and second marginal parts 311, 321 for insertion of the corresponding connecting rods 211 therethrough.

To enable the seat device 3 to be detachably mounted on the modular chair assembly 2, during production, the sleeve portions 342 are in the form of tubular members and are formed by sewing together the first and second marginal parts 311, 321. After the connecting rods 211 are inserted respectively into the sleeve portions 342, two ends of each connecting rod 211 are exposed outwardly of the respective sleeve portion 342 so as to connect with the legs 22 through the link units 23.

Figure 5:
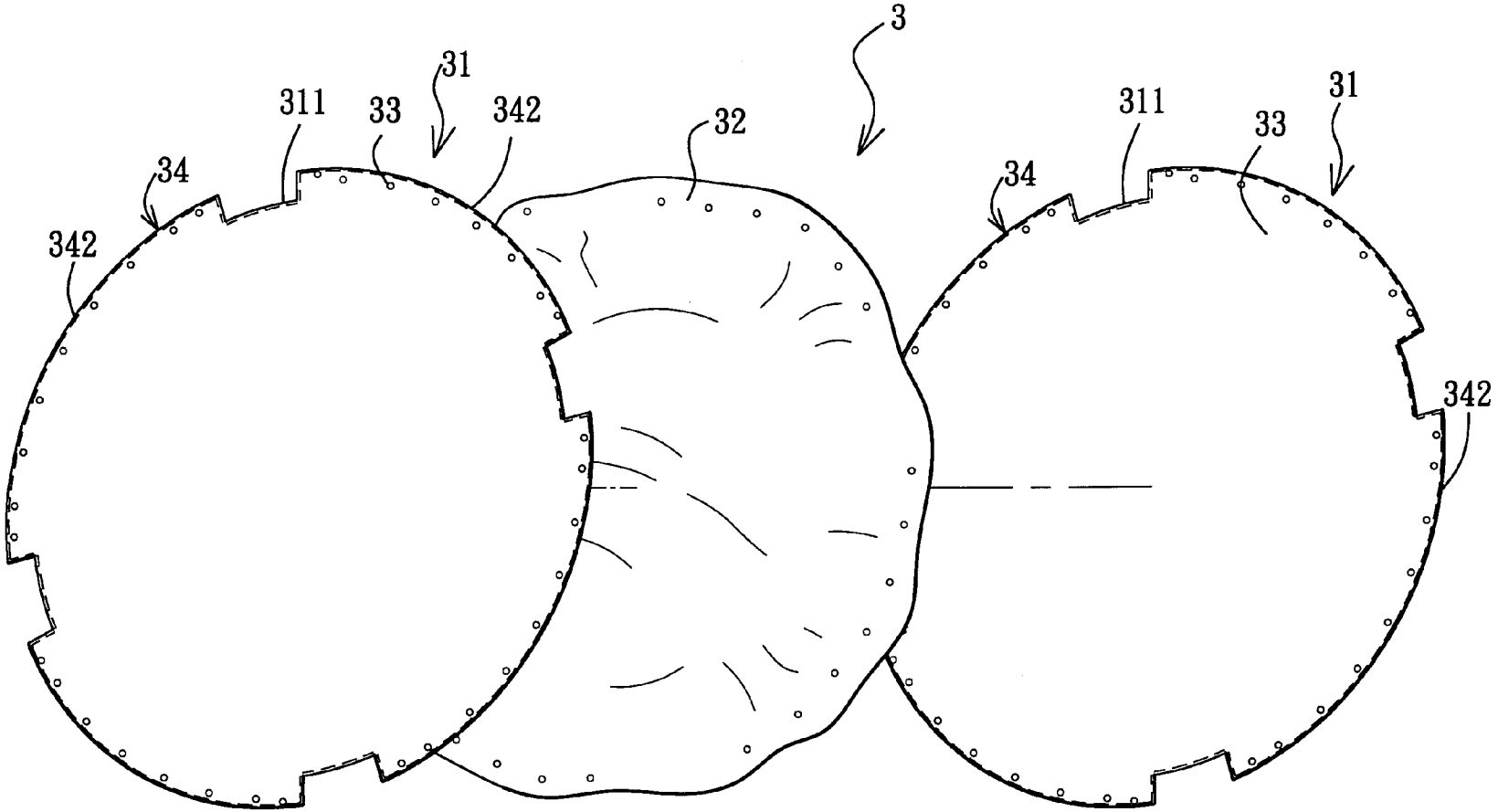
FIG. 5 is an exploded perspective view of the seat device of the present invention in an alternative embodiment.

In an alternative embodiment, a plurality of male and female snap fasteners 33 are attached to the first and second marginal parts 311, 321, as shown in FIG. 5. The sleeve portions 342 of the attachment member 34 are formed when the first and second marginal parts 311, 321 are folded and the male and female snap fasteners 33 are interengaged, so that the seat device 3 can be mounted detachably on the modular chair assembly 2. Since the connection of the seat device 3 to the modular chair assembly 2 may be performed using a variety of methods, it should not be limited to those disclosed in the embodiments.

Figure 6:
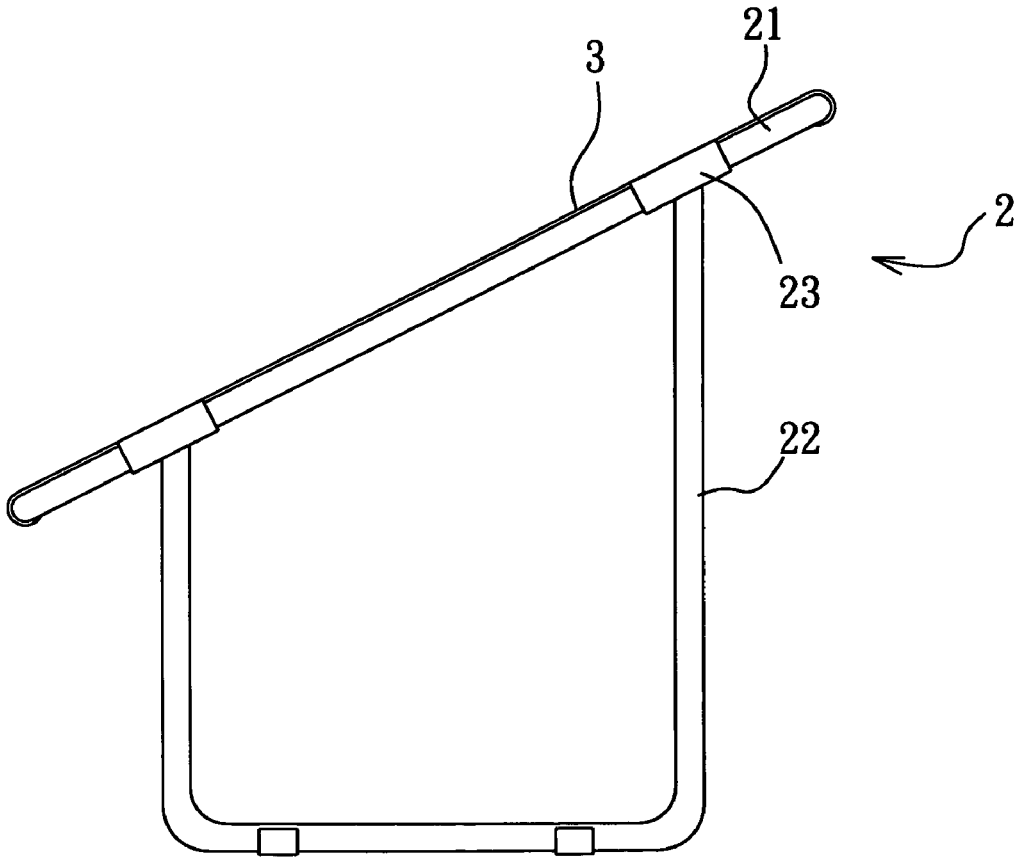
FIG. 6 is a schematic side view of FIG. 3.
Figure 7:
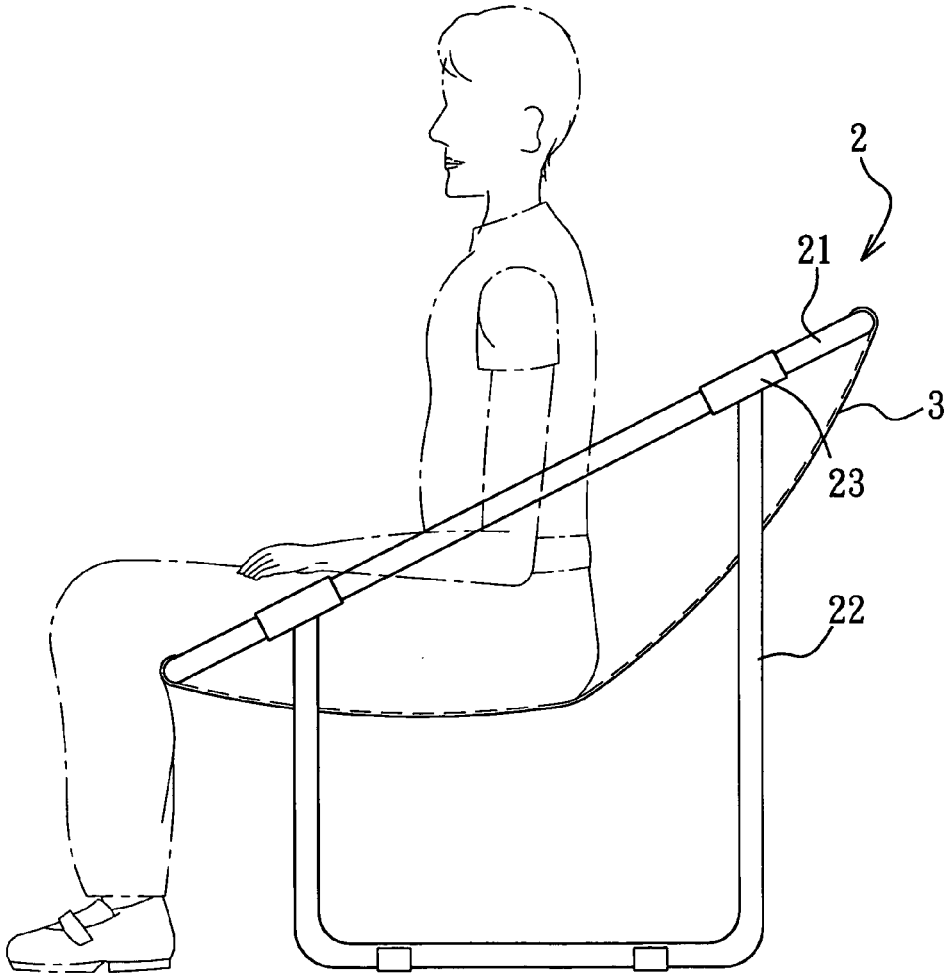
FIG. 7 is a view similar to FIG. 6, but illustrating the seat device of the present invention in a state of use.

Referring to FIGS. 6 and 7, when the seat device 3 is mounted on the main frame 21 of the modular chair assembly 2, the outer sheet layers 31 lay flat, while the inner sheet layer 32 is in a creased state. When a user, shown in phantom lines in FIG. 7, sits on the seat device 3, the outer sheet layers 31 are stretched elastically due to the weight of the user, and the inner sheet layer 32 is spread from a creased state to a smooth state so that the outer and inner sheet layers 31, 32 form a concaved configuration, such as a bowl-shaped configuration. Since the outer sheet layers 31 are elastic, they can deform according to the body shape and weight of the user to thereby provide comfort to the user. The inner sheet layer 32 serves to support and add strength to the outer sheet layers 31. When the user stands up from the chair assembly 2, the outer and inner sheet layers 31, 32, in the absence of an external force, are restored to their respective original positions.

The seat device 3 of the present invention is made circular so as to match the shape of the modular chair assembly 2. However, it may be made non-circular in other embodiments, and should not be limited to the disclosed preferred embodiment.

From the aforementioned description of the preferred embodiment, it is apparent that the seat device 3 of the present invention is ergonomically friendly, so that the feeling of fatigue by the user following long periods of sitting can be minimized, thereby preventing any injury to the spinal cord of the user. Furthermore, since the components used to assemble the seat device 3 are simple, production costs are minimized. Finally, the seat device 3 of the present invention is applicable to different kinds of chairs since it utilizes a simple mounting method.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A seat device for a chair, comprising:

at least two outer sheet layers made of a stretchable elastic textile material, each of said outer sheet layers having a first marginal part surrounding substantially an entire area of a corresponding one of said outer sheet layers;

an inner sheet layer of a textile material sandwiched by said outer sheet layers and having a second marginal part surrounding substantially an entire area of said inner sheet layer, said second marginal part being secured to said first marginal parts; and an attachment member associated with said first and second marginal parts and being adapted to be mounted on the chair;

said entire area of said inner sheet layer being larger than said entire area of a respective one of said outer sheet layers so that said inner sheet layer creases when said outer sheet layers lay flat, said inner and outer sheet layers forming a concaved configuration when a pressure is exerted on said inner and outer sheet layers along a direction transverse to said inner and outer sheet layers;

wherein said textile material of said inner sheet layer includes polyethylene terephthalate fibers.

2. The seat device as claimed in claim 1, wherein said stretchable elastic textile material includes elastomeric polyurethane fibers.

3. A seat device for a chair, comprising:

at least two outer sheet layers made of a stretchable elastic textile material, each of said outer sheet layers having a first marginal part surrounding substantially an entire area of a corresponding one of said outer sheet layers;

an inner sheet layer of a textile material sandwiched by said outer sheet layers and having a second marginal part surrounding substantially an entire area of said inner sheet layer, said second marginal part being secured to said first marginal parts; and an attachment member associated with said first and second marginal parts and being adapted to be mounted on the chair;

said entire area of said inner sheet layer being larger than said entire area of a respective one of said outer sheet layers so that said inner sheet layer creases when said outer sheet layers lay flat, said inner and outer sheet layers forming a concaved configuration when a pressure is exerted on said inner and outer sheet layers along a direction transverse to said inner and outer sheet layers, wherein said inner sheet layer is substantially bowl-shaped.

4. A seat device for a chair, comprising:

at least two outer sheet layers made of a stretchable elastic textile material, each of said outer sheet layers having a first marginal part surrounding substantially an entire area of a corresponding one of said outer sheet layers;

an inner sheet layer of a textile material sandwiched by said outer sheet layers and having a second marginal part surrounding substantially an entire area of said inner sheet layer, said second marginal part being secured to said first marginal parts; and an attachment member associated with said first and second marginal parts and being adapted to be mounted on the chair;

said entire area of said inner sheet layer being larger than said entire area of a respective one of said outer sheet layers so that said inner sheet layer creases when said outer sheet layers lay flat, said inner and outer sheet layers forming a concaved configuration when a pressure is exerted on said inner and outer sheet layers along a direction transverse to said inner and outer sheet layers;

wherein said textile material of said inner sheet layer is a non-elastic material.

* * * * *